US008456497B2

(12) United States Patent
Iguchi et al.

(10) Patent No.: US 8,456,497 B2
(45) Date of Patent: Jun. 4, 2013

(54) DECOLORING APPARATUS TO CONTINUOUSLY ERASE IMAGES OF SHEETS, DECOLORING SYSTEM AND PAPER FEEDING METHOD OF DECOLORING APPARATUS

(75) Inventors: Ken Iguchi, Shizuoka-ken (JP); Isao Yahata, Shizuoka-ken (JP); Takahiro Kawaguchi, Shizuoka-ken (JP); Hiroyuki Taguchi, Shizuoka-ken (JP); Hiroyuki Tsuchihashi, Shizuoka-ken (JP); Hiroyuki Taki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 117 days.

(21) Appl. No.: 13/205,423

(22) Filed: Aug. 8, 2011

(65) Prior Publication Data

US 2012/0038733 A1 Feb. 16, 2012

Related U.S. Application Data

(60) Provisional application No. 61/372,425, filed on Aug. 10, 2010.

(51) Int. Cl.
*B41J 2/325* (2006.01)

(52) U.S. Cl.
USPC ..... 347/179

(58) Field of Classification Search
USPC ..... 347/179
See application file for complete search history.

(56) References Cited

U.S. PATENT DOCUMENTS

| | | | | |
|---|---|---|---|---|
| 2011/0065056 | A1 | 3/2011 | Iguchi et al. | |
| 2011/0221852 | A1* | 9/2011 | Yahata et al. | 347/179 |
| 2012/0038732 | A1* | 2/2012 | Iguchi et al. | 347/179 |
| 2012/0038958 | A1* | 2/2012 | Iguchi et al. | 358/505 |

OTHER PUBLICATIONS

U.S. Appl. No. 13/042,412, Yahata, et al.

* cited by examiner

*Primary Examiner* — Huan Tran
(74) *Attorney, Agent, or Firm* — Patterson & Sheridan, LLP

(57) ABSTRACT

A decoloring apparatus includes a conveyance path, a paper feeding part, a reading part, a communication part, a decoloring part and a control part. The conveyance path conveys a sheet to respective parts in the apparatus. The paper feeding part feeds a sheet on which an image is formed by a decolorable colorant to the conveyance path from a sheet stack part. The reading part is provided downstream of the paper feeding part in the conveyance path and reads the image of the sheet. The communication part transmits read image data of a preceding sheet to a management apparatus communicably connected to the decoloring apparatus and receives a determination result of a conveyance destination of the preceding sheet obtained by the management apparatus based on the image data. The decoloring part is provided downstream of the reading part in the conveyance path and erases the image of the sheet. After the communication part receives the determination result of the conveyance destination of the preceding sheet obtained by the management apparatus, the control part conveys the preceding sheet subjected to reading to the determined conveyance destination, and reads an image of a subsequent sheet by the reading part so that a leading edge of the subsequent sheet does not collide with a trailing edge of the preceding sheet.

20 Claims, 12 Drawing Sheets

DECOLORING APPARATUS TO CONTINUOUSLY ERASE IMAGES OF SHEETS, DECOLORING SYSTEM AND PAPER FEEDING METHOD OF DECOLORING APPARATUS

CROSS-REFERENCE TO RELATED APPLICATION

This application is based upon and claims the benefit of priority from U.S. provisional application 61/372,425, filed on Aug. 10, 2010; the entire contents of which are incorporated herein by reference.

FIELD

Embodiments described herein relate generally to a technique to continuously decolor images of sheets.

BACKGROUND

Hitherto, a decoloring apparatus is known in which first, an image on a sheet is read, and next, a decoloring possible or impossible determination is made based on the read image data, and a decoloring process is performed only on a sheet determined that decoloring can be performed. In the decoloring apparatus as stated above, when the decoloring possible or impossible determination is made by the apparatus itself, the cost of the apparatus becomes high. Thus, there is a decoloring apparatus in which the decoloring possible or impossible determination is made by a management apparatus, and the determination result is received from the management apparatus.

However, in the decoloring apparatus as stated above, when the management apparatus is a PC (Personal Computer) having low processing performance, a lot of time is required for the PC to output the determination result. The decoloring apparatus can not perform the decoloring process until the determination result is received from the PC. Thus, after a reading part reads an image of a sheet, the decoloring apparatus can not directly convey the sheet to a decoloring part, and the sheet is required to be once stopped between the reading part and the decoloring part. Thus, in the decoloring apparatus, when a series of processes are continuously performed on sheets, when a lot of time is taken until the determination result is received from the PC, there is a fear that a subsequent sheet collides with a preceding sheet stopped between the reading part and the decoloring part, and a conveyance jam occurs.

DETAILED DESCRIPTION

In general, according to one embodiment, a decoloring apparatus includes a conveyance path, a paper feeding part, a reading part, a communication part, a decoloring part and a control part. The conveyance path conveys a sheet to respective parts in the apparatus. The paper feeding part feeds a sheet on which an image is formed by a decolorable colorant to the conveyance path from a sheet stack part. The reading part is provided downstream of the paper feeding part in the conveyance path and reads the image of the sheet. The communication part transmits read image data of a preceding sheet to a management apparatus communicably connected to the decoloring apparatus and receives a determination result of a conveyance destination of the preceding sheet obtained by the management apparatus based on the image data. The decoloring part is provided downstream of the reading part in the conveyance path and decolors the image of the sheet. After the communication part receives the determination result of the conveyance destination of the preceding sheet obtained by the management apparatus, the control part conveys the preceding sheet subjected to reading to the determined conveyance destination and reads an image of a subsequent sheet by the reading part so that a leading edge of the subsequent sheet does not collide with a trailing edge of the preceding sheet.

Hereinafter, embodiments will be described with reference to the drawings

First Embodiment

Figure 1:
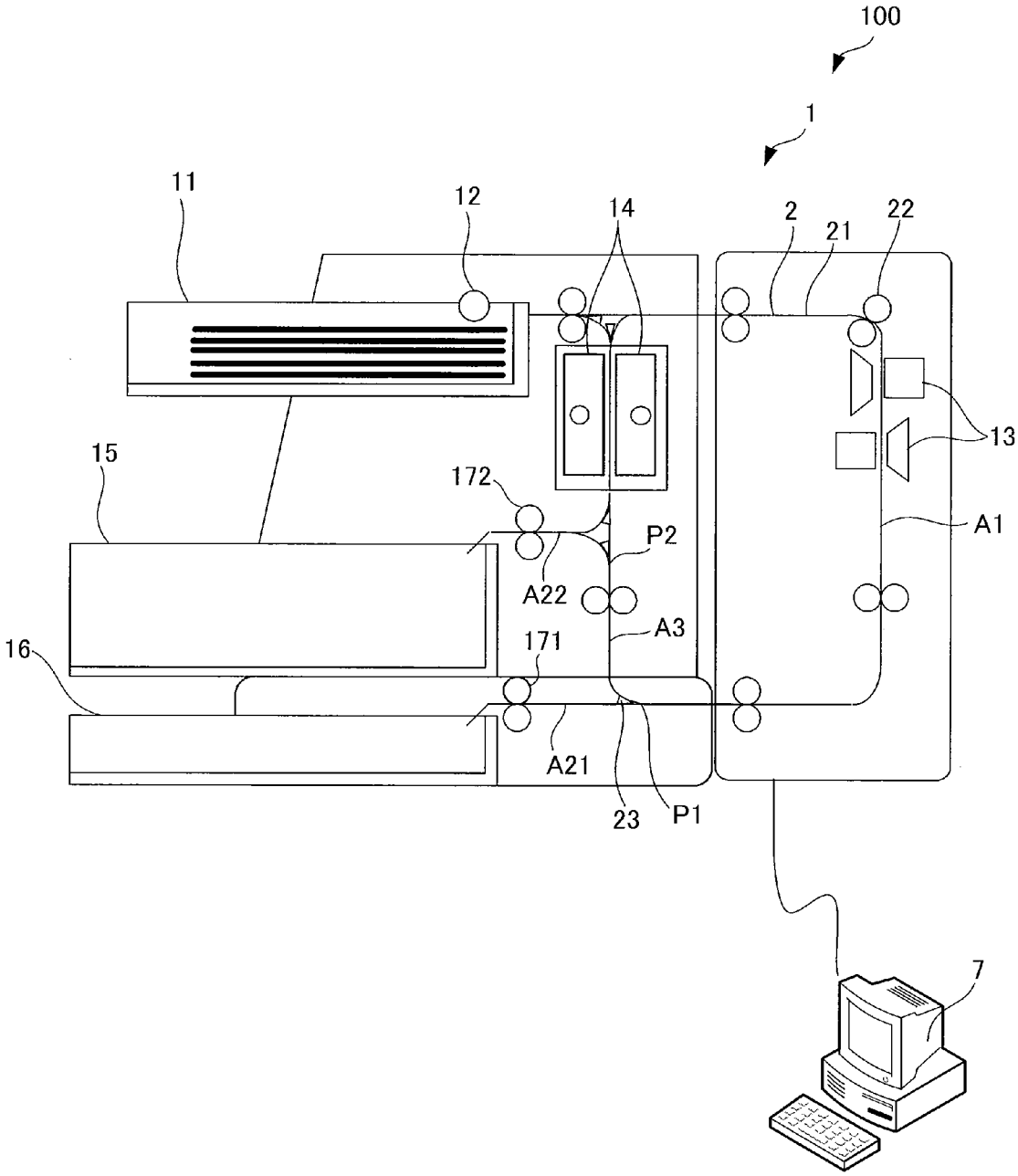
FIG. 1 is a view showing a decoloring system.

FIG. 1 is a view showing a decoloring system 100.

The decoloring system 100 includes a decoloring apparatus 1, and a management apparatus 7 communicably connected to the decoloring apparatus 1 through a data bus or the like.

The decoloring apparatus 1 includes a paper feed tray 11 (sheet stack part), a paper feeding part 12, a conveyance path 2, a reading part 13, a decoloring part 14, a recyclable sheet tray 15, an unrecyclable sheet tray 16, and paper discharge parts 171 and 172.

The paper feed tray 11 stacks sheets of A4 size or the like. On the sheet contained in the paper feed tray 11, an image is formed by decolorable colorant which is decolored by heating.

The paper feeding part 12 includes a pickup roller, a paper feed roller and a separation roller, and feeds the sheet on the paper feed tray 11 to the conveyance path 2.

The conveyance path 2 conveys the sheet to the respective parts in the apparatus 1. The conveyance path 2 includes an annular conveyance path A1 to convey the sheet fed from the paper feeding part 12 through the reading part 13, the decoloring part 14 and the reading part 13. In the conveyance path 2, branches P1, P2 between paper discharge conveyance paths A21, A22 to discharge the sheet and a decoloring conveyance path A3 to convey the sheet to the decoloring part 14 is disposed downstream of the reading part 13 in the sheet conveyance direction. The conveyance path 2 at the downstream side of the decoloring part 14 in the sheet conveyance direction meets a portion between the paper feeding part 12 and the reading part 13. The conveyance path 2 includes a conveyance path body 21 to guide the sheet in the conveyance direction, plural conveyance rollers 22 to send the sheet to the downstream side in the conveyance direction, and plural flappers 23 that are disposed at the respective branch points and distribute the sheet to one of the conveyance paths.

The reading part 13 is provided downstream of the paper feeding part 12 in the conveyance path 2 and reads an image of the sheet. The two reading parts 13 for reading the front surface and the back surface of the sheet are provided, and can read images of the front and back surfaces of the sheet at one time. As the reading part 13, for example, a CCD (Charge Coupled Device Image Sensor) can be adopted.

The decoloring part 14 is provided downstream of the reading part 13 in the conveyance path 2, and heats the sheet to decolor the image of the sheet. The two decoloring parts 14 for erasing the front surface of the sheet and for erasing the back surface of the sheet are provided, and can decolor the images of both surfaces of the sheet at one time.

The recyclable sheet tray 15 contains the sheet the image on which is decolored and which can be recycled.

The unrecyclable sheet tray 16 contains the sheet the image on which is not decolored and which can not recycled.

The paper discharge parts 171, 172 include a paper discharge roller, and discharge the sheet to the trays 15, 16.

In general, in the decoloring apparatus, there is a case where residual color occurs on a sheet. However, in a sheet on which normal data is printed, even if there is a slight residual color, the sheet can be recycled. However, in a sheet on which specific data such as confidential data is printed, when residual color occurs, the sheet can not be recycled.

Then, the management apparatus 7 receives image data of a sheet from the decoloring apparatus 1, and makes a decoloring possible or impossible determination to determine whether the image data includes inhibition data to inhibit decoloring, such as confidential data, and to determine a conveyance destination of the sheet. That is, when the image data includes the inhibition data to inhibit decoloring, the management apparatus 7 determines that the sheet can not be decolored, and determines that the conveyance destination of the sheet is the unrecyclable sheet tray 16. When the image data does not include the inhibition data, the management apparatus determines that the sheet can be decolored decolored, and determines that the conveyance destination of the sheet is the decoloring part 14.

Besides, the management apparatus 7 receives the image data of the decolored sheet from the decoloring apparatus 1, and makes, based on the received image data, a recycle possible or impossible determination from the degree of residual color of the sheet to determine whether the sheet can be recycled and to determine the conveyance destination of the sheet. Specifically, based on the image data of the decolored sheet, when the amount of the residual color of the sheet is a specified amount or less, the management apparatus 7 determines that the sheet can be recycled and determines that the conveyance destination of the sheet is the recyclable sheet tray 15. When the amount of the residual color of the sheet is the specified amount or more, the management apparatus determines that the sheet can not be recycled and determines that the conveyance destination of the sheet is the unrecyclable sheet tray 16.

A general-purpose PC can be adopted as the management apparatus 7.

Figure 2:
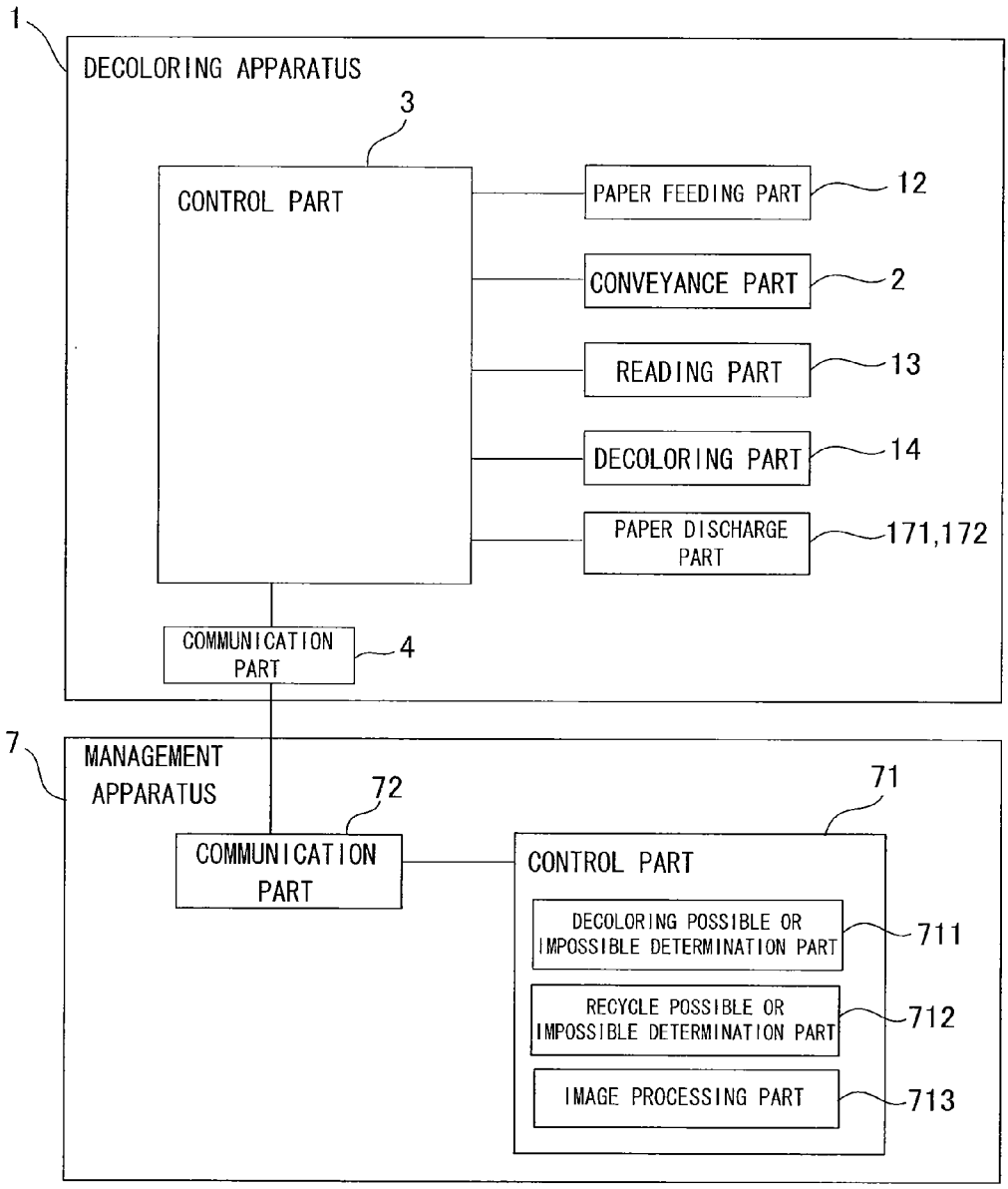
FIG. 2 is a function block diagram of a decoloring apparatus and a management apparatus.

FIG. 2 is a function block diagram of the decoloring apparatus 1 and the management apparatus 7.

The decoloring apparatus 1 includes a control part 3 and a communication part 4.

The control part 3 includes a processor, an ASIC (Application Specific Integrated Circuit), a memory and a HDD (Hard Disk Drive), and controls the whole decoloring apparatus 1.

The communication part 4 transmits the read image data to the management apparatus 7, and receives the determination result (decoloring possible or impossible determination result and recycle possible or impossible determination result) of the conveyance destination of the sheet obtained by the management apparatus 7 based on the image data.

The management apparatus 7 includes a control part 71 and a communication part 72.

The control part 71 includes a processor, an ASIC, a memory and a HDD, and controls the whole management apparatus 7. The control part 71 includes, as function parts, a decoloring possible or impossible determination part 711 to make a decoloring possible or impossible determination, a recycle possible or impossible determination part 712 to make a recycle possible or impossible determination, and an image processing part 713. The control part 71 makes the decoloring possible or impossible determination and the recycle possible or impossible determination to determine the conveyance destination of the sheet based on the image-processed image data. The image processing part 713 image-processes the received image data in order to make the decoloring possible or impossible determination and the recycle possible or impossible determination.

Hereinafter, a decoloring process by the decoloring apparatus 1 will be described with reference to flowcharts of FIG. 3 and FIG. 4. The processor reads a program non-temporarily stored in the memory and the decoloring apparatus 1 performs the decoloring process.

Figure 5:
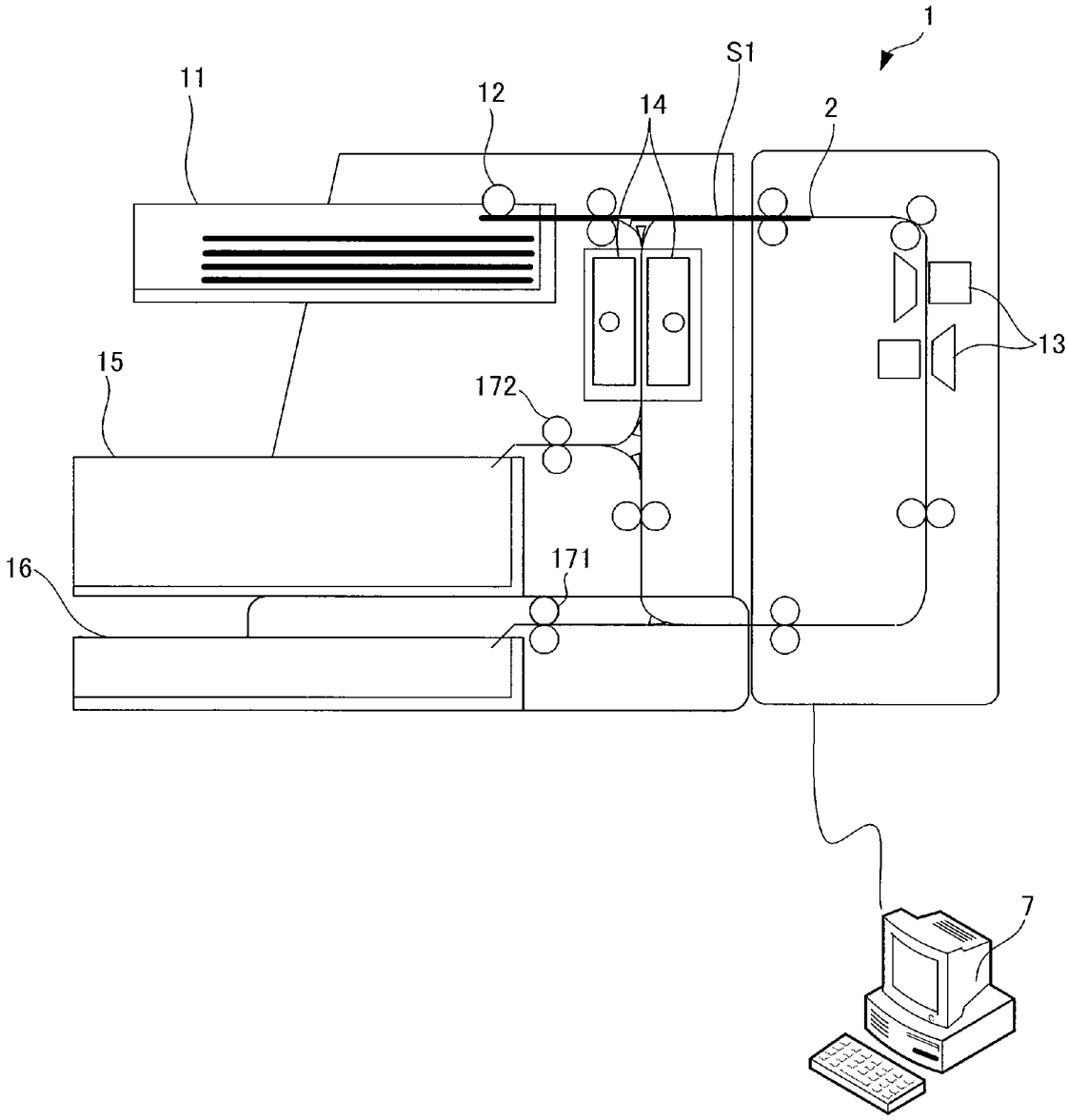
FIG. 5 is a view showing a state where a paper feeding part takes out a sheet from a paper feed tray.

First, the control part 3 of the decoloring apparatus 1 causes the paper feeding part 12 to take out a first sheet S1 (preceding sheet) on which an image is formed by decolorable colorant from the paper feed tray 11 (FIG. 5) and to feed the sheet to the conveyance path 2 (Act 1).

Figure 6:
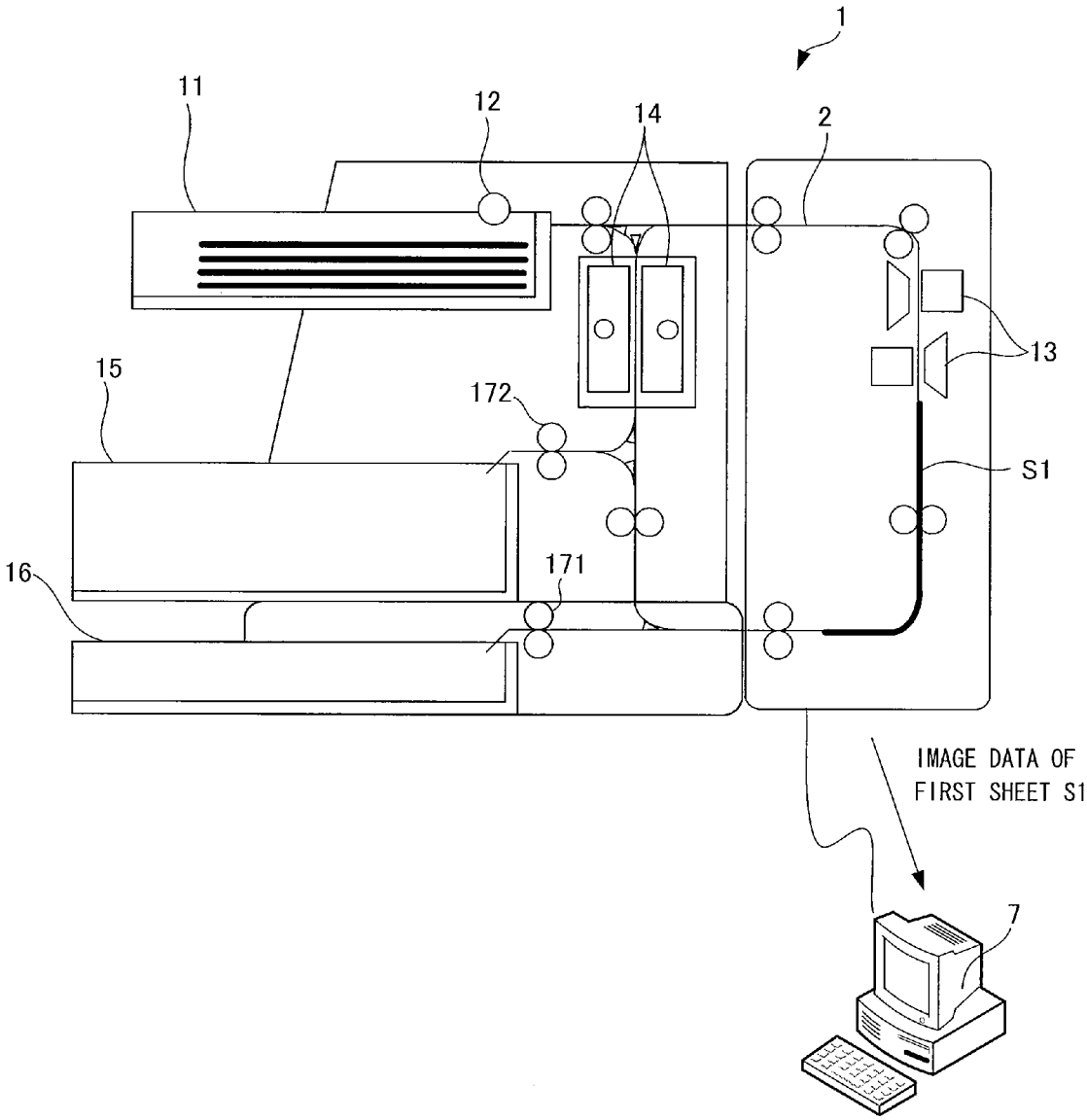
FIG. 6 is a view showing a state where a reading part reads an image of a first sheet.

As shown in FIG. 6, the control part 3 reads the image of the first sheet S1 by the reading part 13 and transmits the image data to the management apparatus 7 through the communication part 4 (Act 2). The control part 3 causes the sheet from which the image is read to stand by between the reading part 13 and the decoloring part 14 in the conveyance path 2.

The management apparatus 7 image-processes the image data, and determines, based on the image-processed image data, whether the image data includes inhibition data to inhibit decoloring, such as confidential data, that is, whether the sheet can be decolored, and determines the conveyance destination of the sheet. Specifically, when the image data includes the inhibition data, the management apparatus 7 determines that the sheet cannot be decolored, and determines that the conveyance destination of the sheet is the unrecyclable sheet tray 16. When the image data does not include the inhibition data, the management apparatus determines that the sheet can be decolored, and determines that the conveyance destination of the sheet is the decoloring part 14.

When receiving the decoloring possible or impossible determination result (Act 3), the control part 3 feeds a second sheet S2 (subsequent sheet) to the conveyance path 2 (Act 4).

Figure 7:
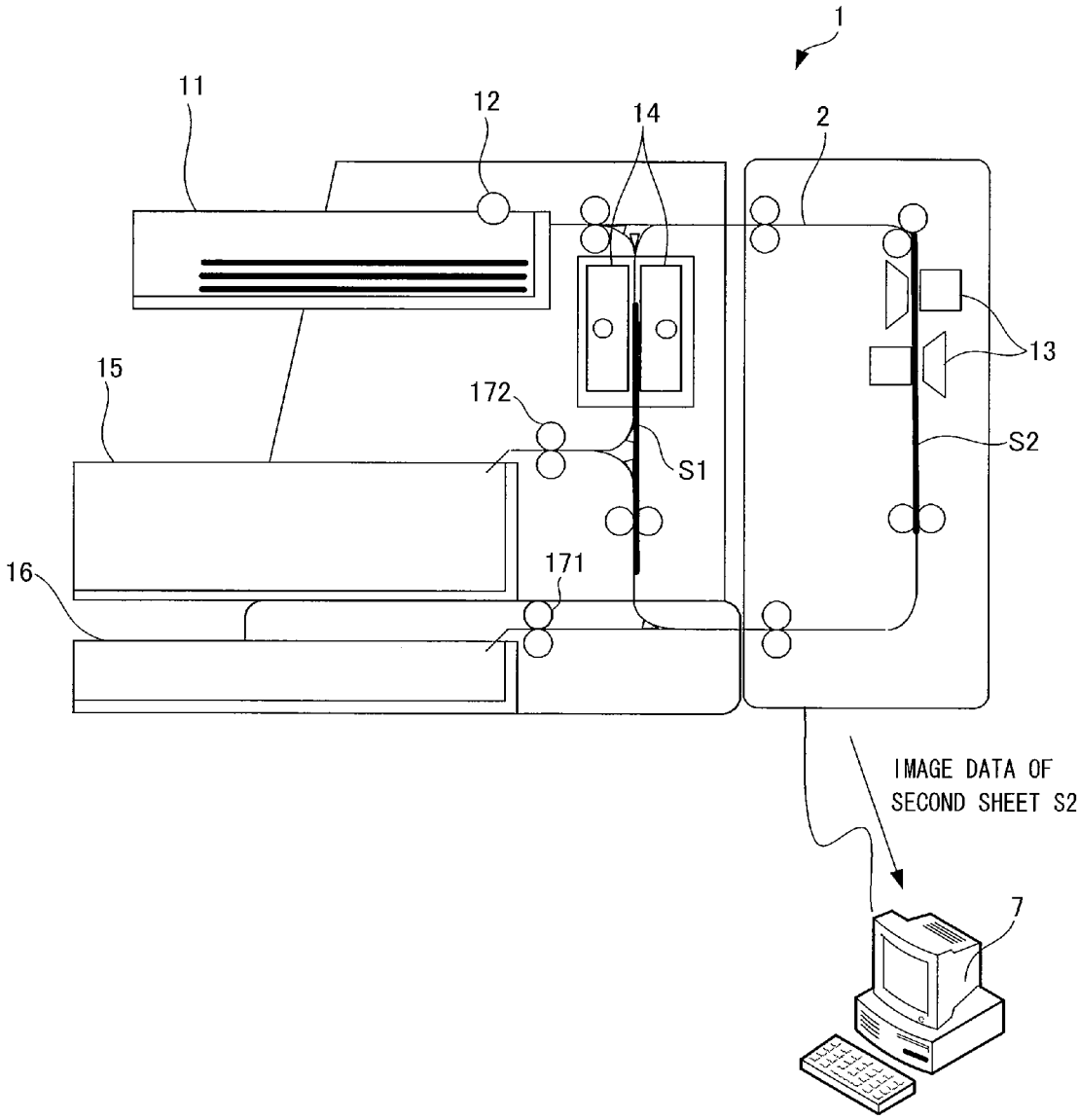
FIG. 7 is a view showing positions of the first and second sheets when the second sheet is read.

When the decoloring possible or impossible determination result is that the first sheet S1 can be decolored and the conveyance destination is the decoloring part 14 (Act 5: YES), as shown in FIG. 7, the control part 3 conveys the first sheet S1, which stands by between the reading part 13 and the decoloring part 14, to the decoloring part 14 and color-erases the image of the sheet S1 by the decoloring part 14, and reads the image of the second sheet S2 by the reading part 13 (Act 6).

Figure 8:
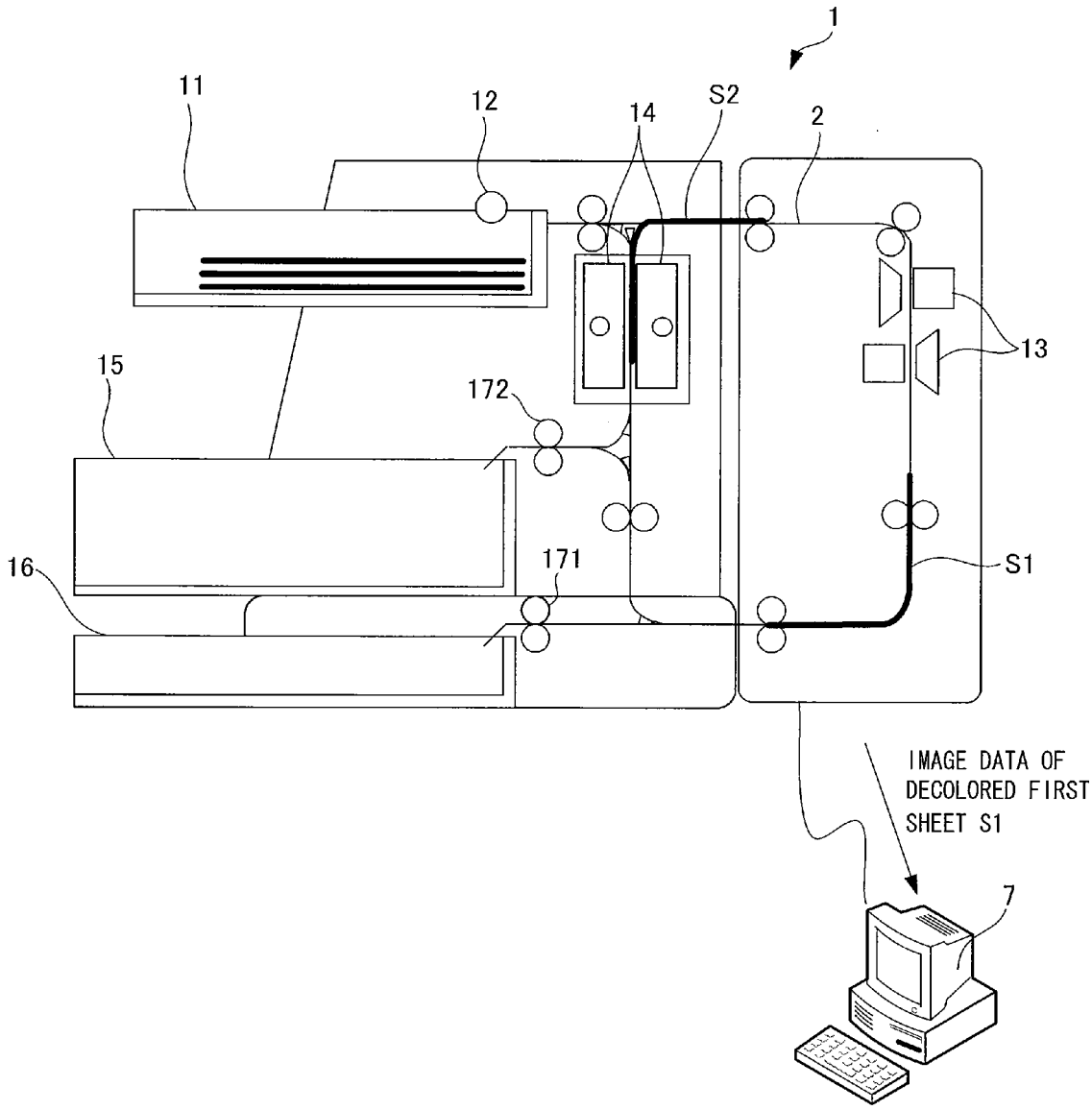
FIG. 8 is a view showing positions of the first and second sheets when the second sheet is decolored.

As shown in FIG. 8, the control part 3 reads the decolored surface of the decolored first sheet S1 by the reading part 13 and transmits the image data to the management apparatus 7, and color-erases the image of the second sheet S2 by the decoloring part 14 (Act 7).

The management apparatus 7 image-processes the image data of the decolored surface of the first sheet S1. Then, based on the image-processed image data, the management apparatus 7 makes such a recycle possible or impossible determination that when an amount of residual color of the first sheet S1 is a specified amount or less, determination is that the first sheet S1 can be recycled and the conveyance destination is the recyclable sheet tray 15, and when the amount of the residual color of the sheet is the specified amount or more, determination is that the first sheet S1 can not be recycled, and the conveyance destination is the unrecyclable sheet tray 16, and transmits the determination result to the decoloring apparatus 1.

The control part 3 receives the recycle possible or impossible determination result (Act 8).

Figure 9:
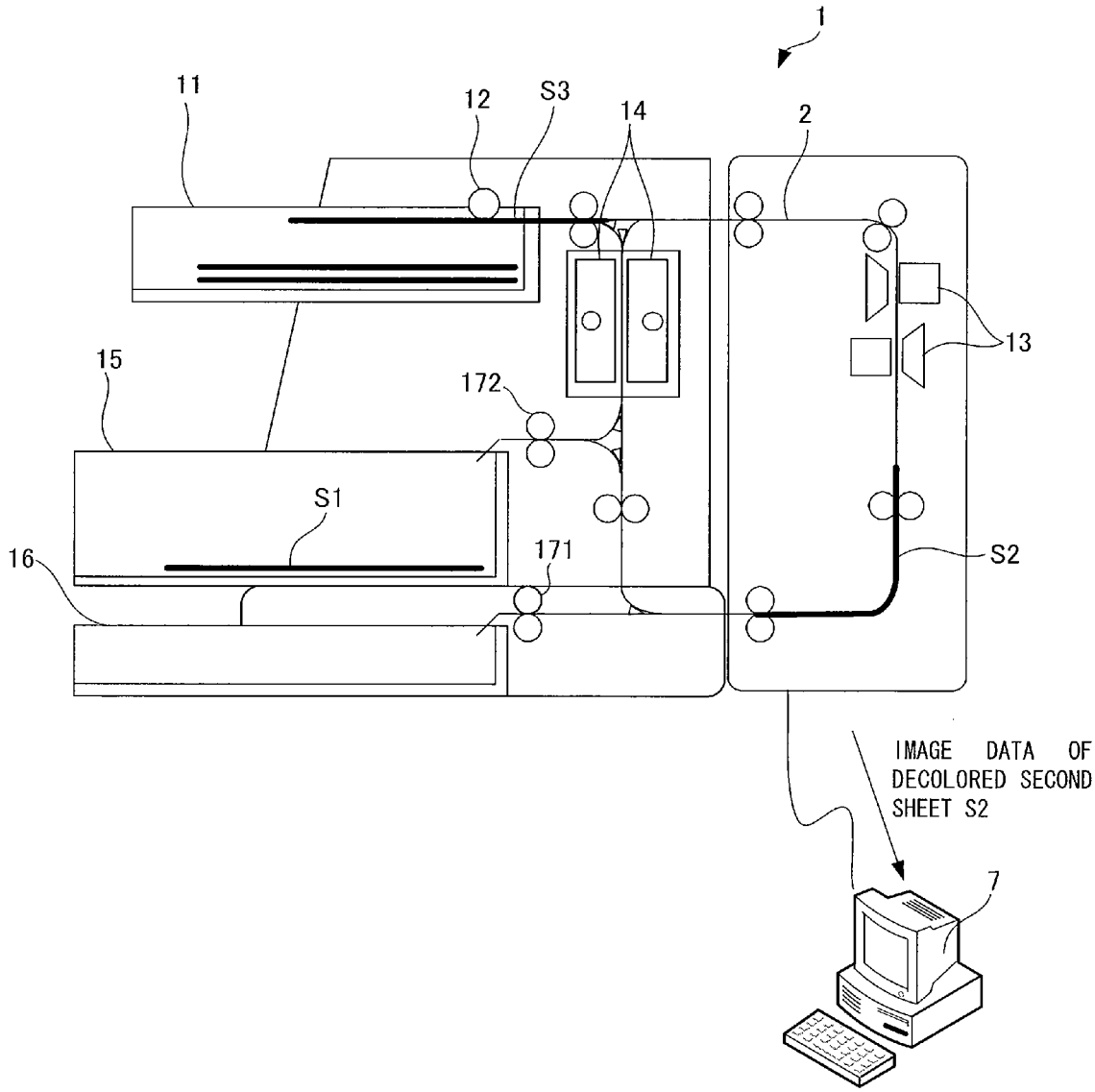
FIG. 9 is a view showing positions of the first to third sheets when the third sheet is fed.

As shown in FIG. 9, when the determination result is that the first sheet S1 can be recycled and the conveyance destination is the recyclable sheet tray 15 (Act 9: YES), the control part 3 discharges the first sheet S1 by the paper discharge part 172 to the recyclable sheet tray 15 (Act 10). When the determination result is that the first sheet S1 can not be recycled and the conveyance destination is the unrecyclable sheet tray 16 (Act 9: NO), the control part 3 discharges the first sheet S1 to the unrecyclable sheet tray 16 by the paper discharge part 171 (Act 11).

The control part 3 discharges the first sheet S1 (Act 10, Act 11), reads the decolored surface of the decolored second sheet S2 by the reading part 13, and transmits the image data to the management apparatus 7 (Act 15).

Incidentally, when the decoloring possible or impossible determination result is that the first sheet S1 can not be decolored and the conveyance destination is the unrecyclable sheet tray 16 (Act 5: NO), the control part 3 discharges the first sheet S1, which stands by between the reading part 13 and the decoloring part 14, to the unrecyclable sheet tray 16 (Act 12). Subsequently, the control part 3 reads the image of the second sheet S2 by the reading part 13 (Act 13), and color-erases the image of the second sheet S2 by the decoloring part 14 (Act 14). The reading part 13 reads the decolored surface of the decolored second sheet S2 and the image data is transmitted to the management apparatus 7 (Act 15).

Based on the image data, the management apparatus 7 makes a recycle possible or impossible determination to determine the conveyance destination of the second sheet S2 by whether the second sheet S2 can be recycled, and transmits the determination result to the decoloring apparatus 1.

The control part 3 receives the recycle possible or impossible determination result (Act 16).

After receiving the recycle possible or impossible determination result, as shown in FIG. 9, the control part 3 feeds a third sheet S3 to the conveyance path 2 (Act 17), and discharges the second sheet S2 to the sheet tray 15 or 16 based on the recycle possible or impossible determination result (Act 18, Act 19).

Thereafter, return is made to Act 2, and the control part 3 performs a process, which is similar to the process to the first sheet S1, to the third sheet S3, and performs a process, which is similar to the process to the second sheet S2, to a fourth sheet (Act 2 to Act 19).

In this embodiment, after receiving the determination result of the conveyance destination of the preceding sheet (for example, the first sheet S1) based on whether the inhibition data is included, the control part 3 conveys the preceding sheet to the conveyance destination of the determination result, feeds the subsequent sheet (for example, the second sheet S2) to the conveyance path 2, and reads the image of the subsequent sheets. Thus, in this embodiment, even if a lot of time is taken for the management apparatus 7 to determine the conveyance destination of the preceding sheet, the subsequent sheet does not collide with the preceding sheet stopped between the reading part 13 and the decoloring part 14, and the occurrence of a conveyance jam can be prevented.

In this embodiment, after receiving the determination result of the conveyance destination of the preceding sheet (for example, the second sheet S2) based on the degree of residual color of the sheet, the control part 3 conveys the preceding sheet to the conveyance destination of the determination result, and feeds the subsequent sheet (for example, the third sheet S3) to the conveyance path 2, and reads the image of the subsequent sheet. Thus, in this embodiment, even if a lot of time is taken for the management apparatus 7 to determine the conveyance destination of the preceding sheet, the subsequent sheet does not collide with the preceding sheet stopped between the reading part 13 and the decoloring part 14, and the occurrence of a conveyance jam can be prevented.

Second Embodiment

Hereinafter, the same function part as that of the foregoing embodiment is denoted by the same reference numeral and the explanation thereof is omitted.

Figure 10:
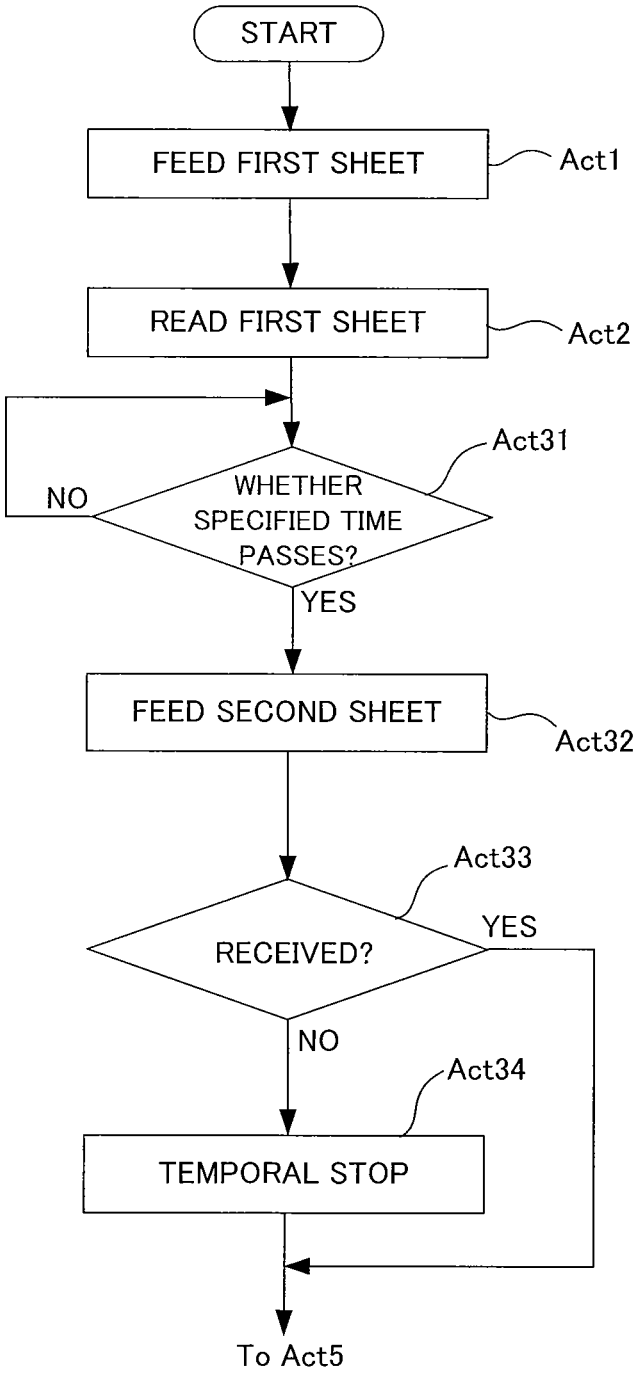
FIG. 10 is a flowchart for explaining another decoloring processing method by a decoloring apparatus.

FIG. 10 is a flowchart for explaining another decoloring processing method of the decoloring apparatus 1.

First, the control part 3 feeds a first sheet S1 to the conveyance path 2 (Act 1), reads the image of the first sheet S1 by the reading part 13, and transmits image data to the management apparatus 7 (Act 2).

After feeding the first sheet S1 to the conveyance path 2 by the paper feeding part 12, the control part 3 feeds a second sheet S2 to the conveyance path 2 after a specified time passes (Act 31: YES) (Act 32).

Figure 11:
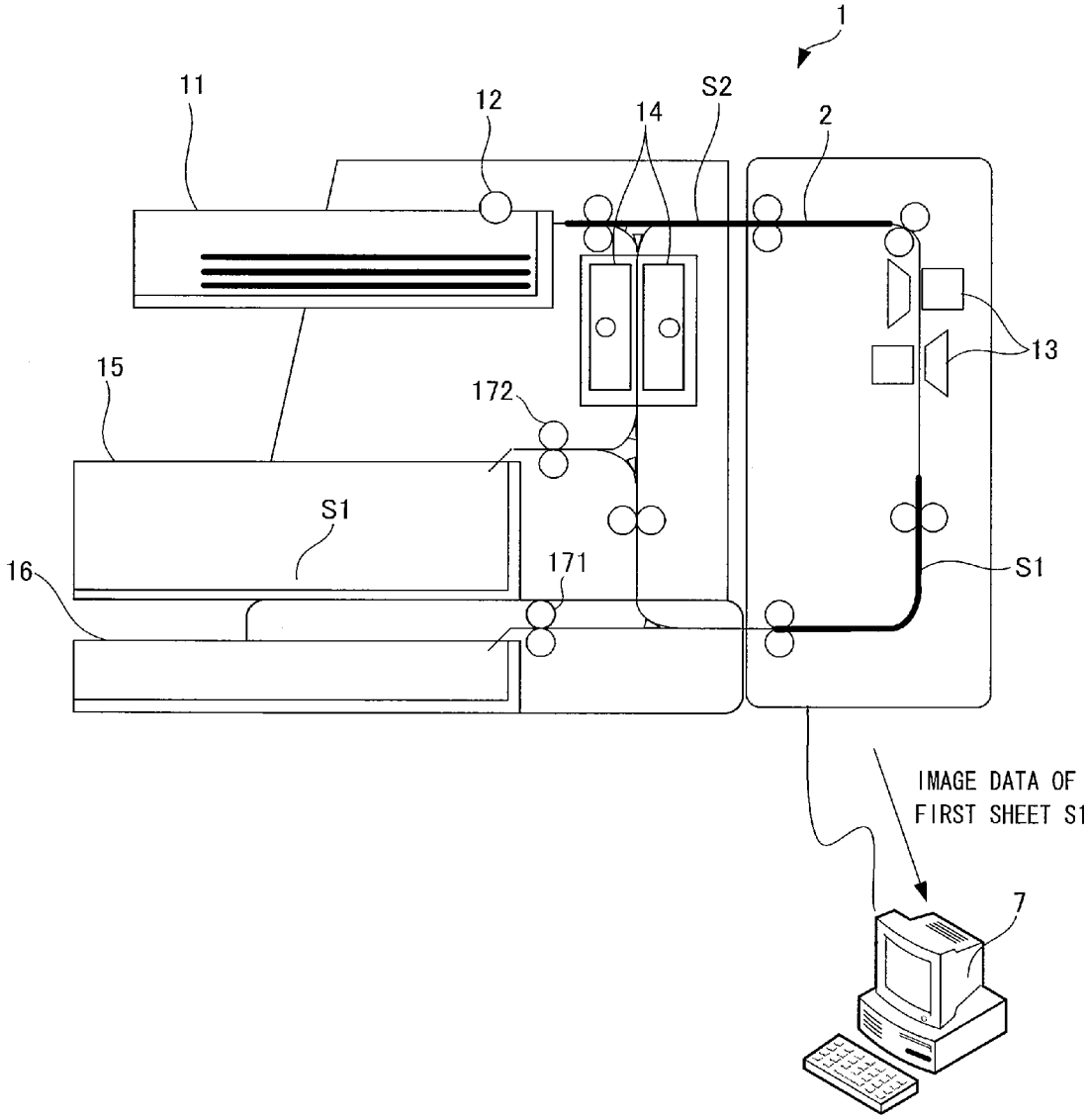
FIG. 11 is a view showing a position of the second sheet when a communication part does not receive a determination result.

As shown in FIG. 11, when the communication part 4 does not receive the determination result of the first sheet S1 before the leading edge of the second sheet S2 reaches the reading part 13 (Act 33: NO), the control part 3 temporarily stops the second sheet S2 in the conveyance path 2 between the paper feeding part 12 and the reading part 13. The subsequent processes are the same as the processes after Act 5 of the first embodiment (Act 11 to Act 19).

Figure 3:
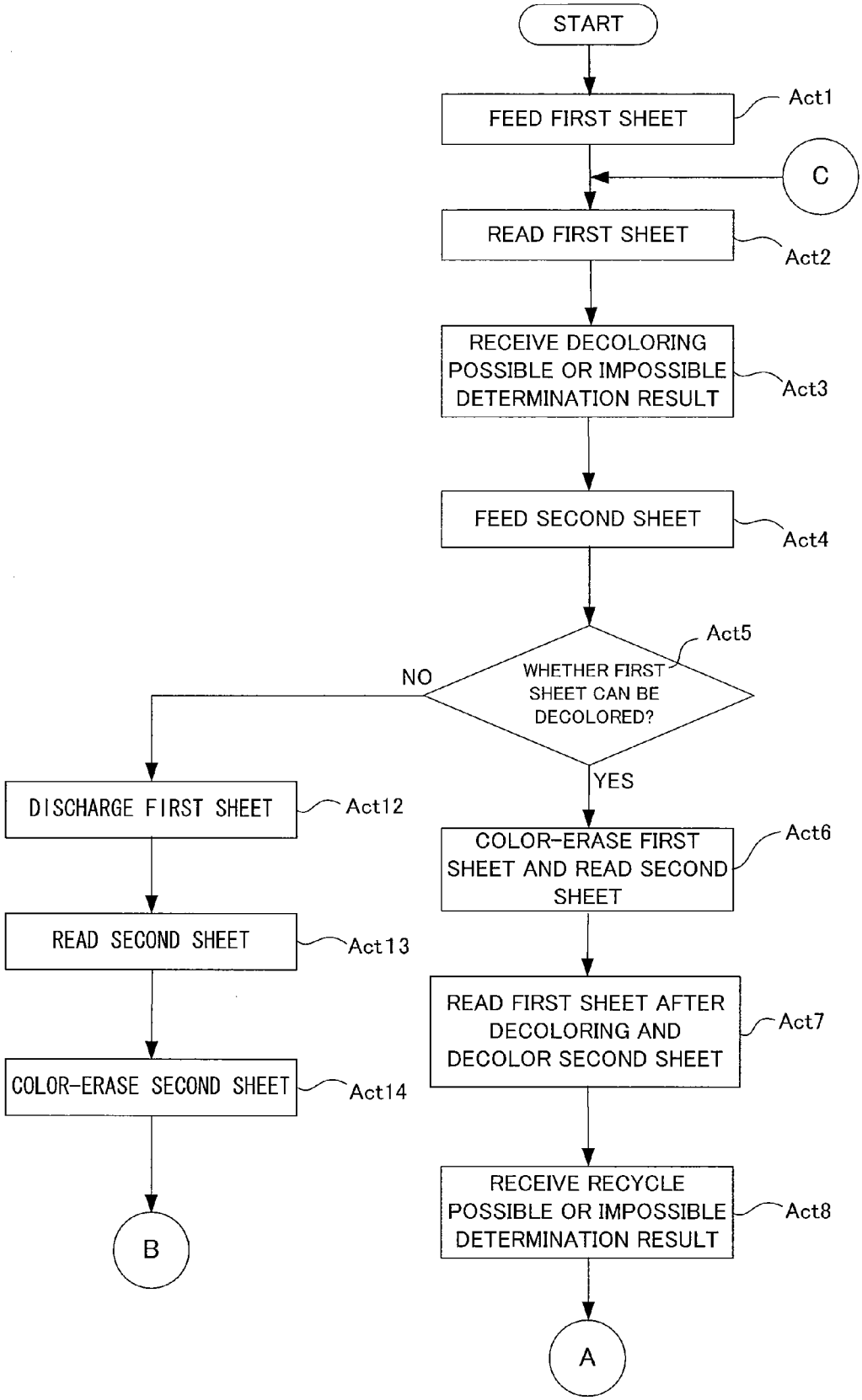
FIG. 3 is a flowchart showing a decoloring process by the decoloring apparatus.
Figure 4:
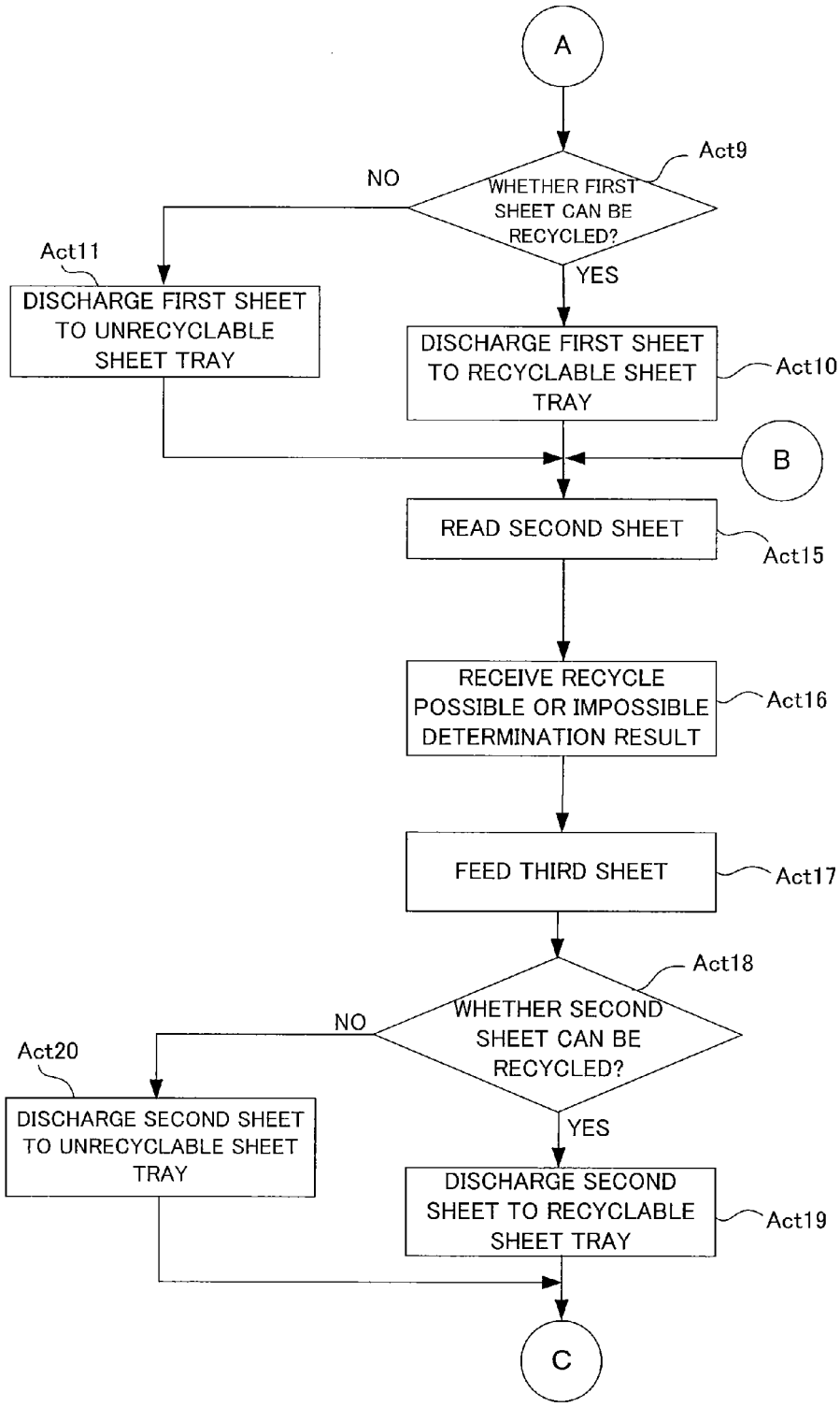
FIG. 4 is a flowchart showing the decoloring process by the decoloring apparatus.

For example, when the determination result is that the first sheet S1 can be decolored and the conveyance destination is the decoloring part 14 (Act 5 of FIG. 3: YES), the control part 3 conveys the first sheet S1, which stands by between the reading part 13 and the decoloring part 14, to the decoloring part 14, and color-erases the image of the sheet S1 by the decoloring part 14. At the same time, the control part 3 reads the image of the second sheet S2 by the reading part 13 so that the leading edge of the second sheet S2 does not collide with the trailing edge of the first sheet S1 (Act 6).

Third Embodiment

Figure 12:
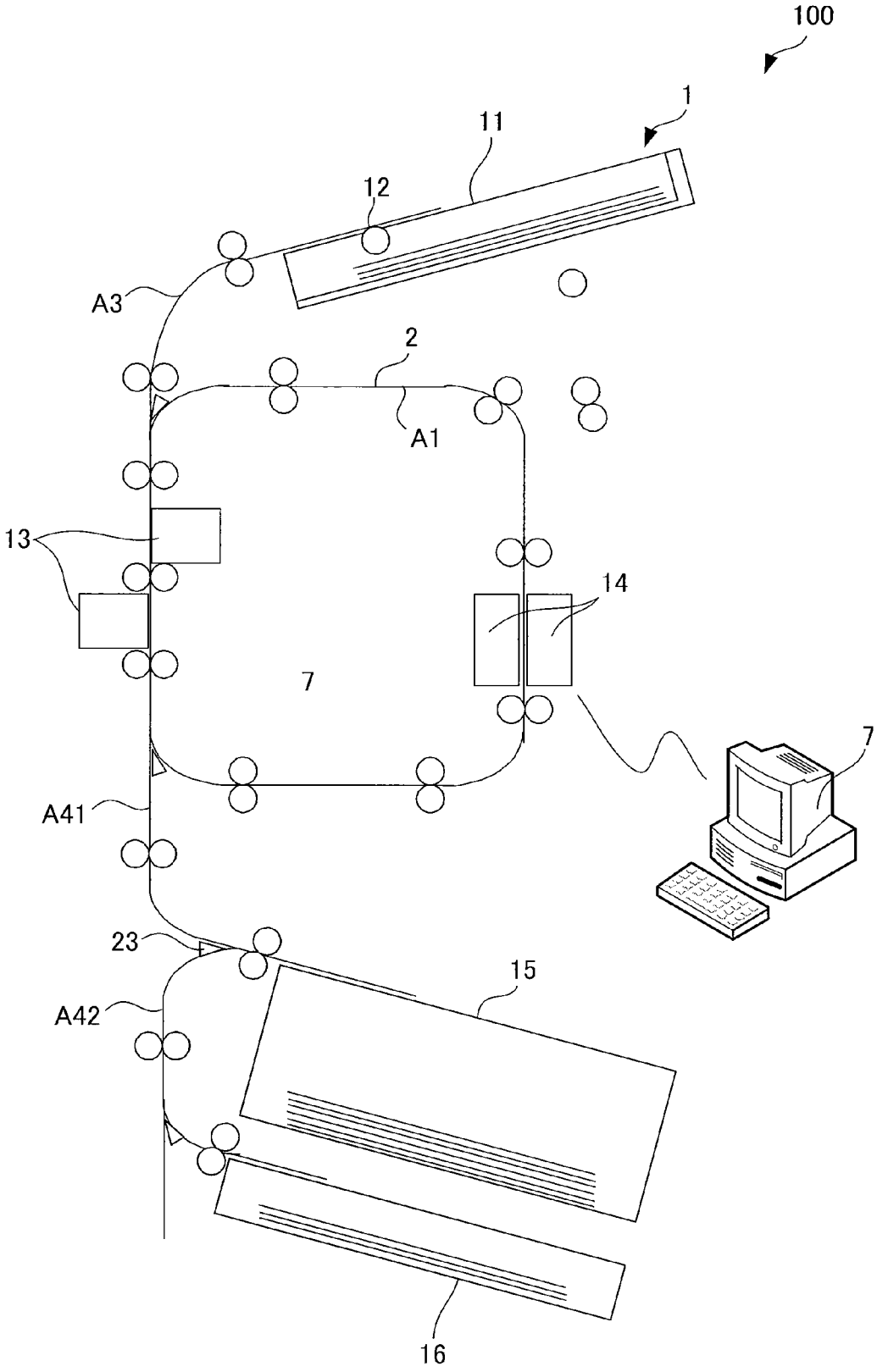
FIG. 12 is a schematic view showing a modified example of a conveyance path.

FIG. 12 is a schematic view showing a modified example of a conveyance path 2.

In the above respective embodiments, positions of the respective parts in the conveyance path 2 are arbitrary. FIG. 12 shows the modified example of the conveyance path 2 in which the positions of the respective parts in the conveyance path 2 are shifted.

In this embodiment, the confluence of a conveyance path A3 from a paper feeding part 12 to an annular conveyance path A1 and the annular conveyance path A1 is not located at a decoloring part 14 side but at a reading part 13 side. Besides, a recyclable sheet tray 15 is connected through a paper discharge conveyance path A41 to the annular conveyance path A1 between the reading part 13 and the decoloring part 14. An unrecyclable sheet tray 16 is located downstream of the recyclable sheet tray 15 in the conveyance direction in the conveyance path 2 and is connected to the recyclable sheet tray 15 through a paper discharge conveyance path A42. Also in this embodiment, the decoloring apparatus 1 performs the same decoloring process as that of the above respective embodiments.

Incidentally, in the above respective embodiments, although the management apparatus 7 specifically determines the conveyance destination of the sheet, for example, the decoloring part 14 or the unrecyclable sheet tray 16, the management apparatus 7 may determine only whether the sheet can be decolored or whether the decolored sheet can be recycled. Even when the management apparatus 7 does not determine to specifically specify the conveyance destination of the sheet, and for example, determines only whether the sheet can be decolored, based on the determination result of the management apparatus 7 as to whether the decoloring can be performed, the control part 3 refers to a table in a memory in which the determination result as to whether decoloring can be performed and the conveyance destination (the decoloring part 14 or the unrecyclable sheet tray 16) are correlated, and may convey the sheet to the decoloring part 14 or the unrecyclable sheet tray 16. Even when the management apparatus 7 does not determine to specifically specify the conveyance destination of the sheet, and for example, determines only whether the sheet can be decolored, there is no difference from the case where the management apparatus 7 substantially determines the conveyance destination of the sheet.

Accordingly, the "determination result of the conveyance destination of the preceding sheet obtained by the management apparatus 7" means not only the result of determining the specific conveyance destination in the decoloring apparatus 1, but also the determination result obtained when the management apparatus 7 determines whether the inhibition data is included in the image data, that is, the determination result of determining whether the sheet can be decolored.

Similarly, the "determination result of the conveyance destination of the preceding sheet obtained by the management apparatus 7" means not only the result obtained when the management apparatus 7 specifically determines, based on the residual color amount of the decolored sheet, that the conveyance destination of the decolored sheet is the recyclable sheet tray 15 or the unrecyclable sheet tray 16 in the decoloring apparatus 1, but also the determination result obtained when the management apparatus 7 determines only whether the sheet can be recycled based on the residual color amount of the decolored sheet.

As the record medium, any form may be used as long as the record medium can store a program and can be read by a computer. Specifically, for example, an internal storage device mounted in the computer, such as a ROM or a RAM, a portable storage medium such as a CD-ROM, a flexible disk, a DVD disk, a magneto-optical disk or an IC card, a database to hold the computer program, another computer and its database can be enumerated as the record medium. The function obtained by installation or download may realize the function in cooperation with the OS or the like in the apparatus. A part or all of the program may be a dynamically generated execution module.

The order of the respective processes in the above respective embodiments may be different from the order exemplified in the embodiments.

As described above in detail, according to the technique described herein, the technique to continuously erase the images of the sheets can be provided.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. A decoloring apparatus to erase an image of a sheet, comprising:

a conveyance path to convey a sheet to respective parts in the apparatus;

a paper feeding part to feed the sheet on which an image is formed by a decolorable colorant to the conveyance path from a sheet stack part;

a reading part that is provided downstream of the paper feeding part in the conveyance path and reads the image of the sheet;

a communication part that transmits read image data of a preceding sheet to a management apparatus communicably connected to the decoloring apparatus and receives a determination result of a conveyance destination of the preceding sheet obtained by the management apparatus based on the image data;

a decoloring part that is provided downstream of the reading part in the conveyance path and erases the image of the sheet; and a control part that conveys the preceding sheet subjected to reading to the determined conveyance destination after the communication part receives the determination result of the conveyance destination of the preceding sheet obtained by the management apparatus, and reads an image of a subsequent sheet by the reading part while preventing a leading edge of the subsequent sheet from colliding with a trailing edge of the preceding sheet.

2. The apparatus of claim 1, wherein after the determination result is received, the control part feeds the subsequent sheet to the conveyance path by the paper feeding part.

3. The apparatus of claim 1, wherein after the paper feeding part feeds the preceding sheet to the conveyance path, the control part feeds the subsequent sheet to the conveyance path after a specified time passes, and when the communication part does not receive the determination result of the preceding sheet before the leading edge of the subsequent sheet reaches the reading part, the control part temporarily stops the subsequent sheet at an upstream side of the reading part in a conveyance direction.

4. The apparatus of claim 1, wherein after the paper feeding part feeds the preceding sheet to the conveyance path, the control part feeds the subsequent sheet to the conveyance path after a specified time passes, and when the communication part does not receive the determination result of the preceding sheet before the leading edge of the subsequent sheet reaches the reading part, the control part reduces speed of the subsequent sheet and conveys the subsequent sheet to the reading part.

5. The apparatus of claim 1, wherein the communication part receives, from the management apparatus, the determination result that when inhibition data to inhibit decoloring is included in the image data, determination is that the preceding sheet can not be decolored and the conveyance destination of the preceding sheet is an unrecyclable sheet tray, and when the inhibition data is not included in the image data, determination is that the preceding sheet can be decolored and the conveyance destination of the preceding sheet is the decoloring part.

6. The apparatus of claim 1, wherein the control part reads a decolored surface of the decolored preceding sheet by the reading part, transmits read image data to the management apparatus through the communication part, and receives the determination result from the management apparatus through the communication part, and based on the image data of the decolored preceding sheet, when an amount of residual color of the preceding sheet is a specified amount or less, the management apparatus determines that the preceding sheet can be recycled and the conveyance destination of the preceding sheet is a recyclable sheet tray, and when the amount of the residual color of the preceding sheet is the specified amount or more, the management apparatus determines that the preceding sheet can not be recycled and the conveyance destination of the preceding sheet is an unrecyclable sheet tray.

7. The apparatus of claim 1, wherein a branch between a paper discharge conveyance path to discharge a sheet and a decoloring conveyance path to convey a sheet to the decoloring part exists downstream of the reading part in a sheet conveyance direction, and the conveyance path at a downstream side of the decoloring part in the sheet conveyance direction meets a portion between the paper feeding part and the reading part.

8. A decoloring system comprising:

a management apparatus that receives image data of a sheet, and outputs a determination result of a conveyance destination of the sheet based on the image data; and a decoloring apparatus including a conveyance path to convey a sheet to respective parts in the apparatus, a paper feeding part to feed the sheet on which an image is formed by a decolorable colorant to the conveyance path from a sheet stack part, a reading part that is provided downstream of the paper feeding part in the conveyance path and reads the image of the sheet, a communication part that transmits read image data of a preceding sheet and receives a determination result of a conveyance destination of the preceding sheet obtained by the management apparatus based on the image data, a decoloring part that is provided downstream of the reading part in the conveyance path and erases the image of the sheet, and a control part that conveys the preceding sheet subjected to reading to the determined conveyance destination after the communication part receives the determination result of the conveyance destination of the preceding sheet obtained by the management apparatus, and reads an image of a subsequent sheet by the reading part while preventing a leading edge of the subsequent sheet from colliding with a trailing edge of the preceding sheet.

9. The system of claim 8, wherein after the determination result is received, the control part feeds the subsequent sheet to the conveyance path by the paper feeding part.

10. The system of claim 8, wherein after the paper feeding part feeds the preceding sheet to the conveyance path, the control part feeds the subsequent sheet to the conveyance path after a specified time passes, and when the communication part does not receive the determination result of the preceding sheet before the leading edge of the subsequent sheet reaches the reading part, the control part temporarily stops the subsequent sheet at a portion between the paper feeding part and the reading part in the conveyance path.

11. The system of claim 8, wherein after the paper feeding part feeds the preceding sheet to the conveyance path, the control part feeds the subsequent sheet to the conveyance path after a specified time passes, and when the communication part does not receive the determination result of the preceding sheet before the leading edge of the subsequent sheet reaches the reading part, the control part temporarily stops the subsequent sheet at an upstream side of the reading part in a conveyance direction.

12. The system of claim 8, wherein the communication part receives, from the management apparatus, the determination result that when inhibition data to inhibit decoloring is included in the image data, determination is that the preceding sheet can not be decolored and the conveyance destination of the preceding sheet is an unrecyclable sheet tray, and when the inhibition data is not included in the image data, determination is that the preceding sheet can be decolored and the conveyance destination of the preceding sheet is the decoloring part.

13. The system of claim 8, wherein the control part reads a decolored surface of the decolored preceding sheet by the reading part, transmits read image data to the management apparatus through the communication part, and receives the determination result from the management apparatus through the communication part, and based on the image data of the decolored preceding sheet, when an amount of residual color of the preceding sheet is a specified amount or less, the management apparatus determines that that the preceding sheet can be recycled and the conveyance destination of the preceding sheet is a recyclable sheet tray, and when the amount of the residual color of the preceding sheet is the specified amount or more, the management apparatus determines that the preceding sheet can not be recycled and the conveyance destination of the preceding sheet is an unrecyclable sheet tray.

14. The system of claim 8, wherein a branch between a paper discharge conveyance path to discharge a sheet and a decoloring conveyance path to convey a sheet to the decoloring part exists downstream of the reading part in a sheet conveyance direction, and the conveyance path at a downstream side of the decoloring part in the sheet conveyance direction meets a portion between the paper feeding part and the reading part.

15. A paper feeding method by a decoloring apparatus that includes a conveyance path to convey a sheet to respective parts in the apparatus, a paper feeding part to feed the sheet on which an image is formed by a decolorable colorant to the conveyance path from a sheet stack part, and a reading part provided downstream of the paper feeding part in the conveyance path and to read the image of the sheet, and is communicably connected to a management apparatus, the paper feeding method comprising:

reading an image of a preceding sheet by the reading part and transmitting read image data of the preceding sheet to the management apparatus;

receiving a determination result of a conveyance destination of the preceding sheet based on the image data from the management apparatus; and conveying the preceding sheet subjected to reading to the determined conveyance destination after the determination result of the conveyance destination of the preceding sheet obtained by the management apparatus is received, and reading an image of a subsequent sheet by the reading part while a leading edge of the subsequent sheet is prevented from colliding with a trailing edge of the preceding sheet.

16. The method of claim 15, wherein after the determination result is received, the subsequent sheet is fed to the conveyance path by the paper feeding part.

17. The method of claim 15, wherein after the preceding sheet is fed to the conveyance path by the paper feeding part, the subsequent sheet is fed to the conveyance path after a specified time passes, and when the determination result of the preceding sheet is not received before the leading edge of the subsequent sheet reaches the reading part, the subsequent sheet is temporarily stopped at an upstream side of the reading part in a conveyance direction.

18. The method of claim 15, wherein after the preceding sheet is fed to the conveyance path by the paper feeding part, the subsequent sheet is fed to the conveyance path after a specified time passes, and when the determination result of the preceding sheet is not received before the leading edge of the subsequent sheet reaches the reading part, speed of the subsequent sheet is reduced and the subsequent sheet is conveyed to the reading part.

19. The method of claim 15, wherein the determination result from the management apparatus is received, in which when inhibition data to inhibit decoloring is included in the image data, determination is that the preceding sheet can not be decolored and the conveyance destination of the preceding sheet is an unrecyclable sheet tray, and when the inhibition data is not included in the image data, determination is that the preceding sheet can be decolored and the conveyance destination of the preceding sheet is the decoloring part.

20. The method of claim 15, wherein a decolored surface of the decolored preceding sheet is read by the reading part, read image data is transmitted to the management apparatus, and the determination result is received from the management apparatus, and based on the image data of the decolored preceding sheet, when an amount of residual color of the preceding sheet is a specified amount or less, the management apparatus determines that the preceding sheet can be recycled and the conveyance destination of the preceding sheet is a recyclable sheet tray, and when the amount of the residual color of the preceding sheet is the specified amount or more, the management apparatus determines that the preceding sheet can not be recycled and the conveyance destination of the preceding sheet is an unrecyclable sheet tray.

* * * * *